United States Patent [19]

Staats

[11] 4,416,222

[45] Nov. 22, 1983

[54] HOT WATER HEATER CIRCUITRY

[75] Inventor: Charles W. Staats, Yeadon, Pa.

[73] Assignee: Bradford-White Corportion, Philadelphia, Pa.

[21] Appl. No.: 260,741

[22] Filed: May 5, 1981

[51] Int. Cl.[3] ..... F22B 5/00

[52] U.S. Cl. ..... 122/13 R; 62/238.6; 137/590; 237/61; 237/19

[58] Field of Search ..... 122/13 R; 220/86 R; 126/36 L; 237/19, 61; 62/238.6; 137/590

[56] References Cited

U.S. PATENT DOCUMENTS 306,837 10/1884 Klein ..... 122/13 R
759,380 5/1904 Kane ..... 122/13 R
2,794,658 6/1957 Purkhiser ..... 122/13 R
4,175,698 11/1979 Brosenius ..... 237/61

*Primary Examiner*—Albert J Makay
*Assistant Examiner*—Henry Bennett
*Attorney, Agent, or Firm*—Austin R. Miller

[57] ABSTRACT

Dual flow circuitry is utilized to transport fluid held in a tank through a heating means by providing means for carrying both inflow and outflow streams and means for depositing the inflowing stream at a predetermined level in the tank while utilizing only one tank opening. The dual flow circuitry can be used to supplement an ordinary residential or other hot water heating system with a heat pump.

4 Claims, 2 Drawing Figures

HOT WATER HEATER CIRCUITRY

BACKGROUND OF THE INVENTION

1. Field of the Invention

This invention relates to hot water heater circuitry, and particularly relates to a novel combination of a hot water heater with external heating means and to novel means for operatively connecting the two for efficient cooperation. In a more specific aspect, this invention also relates to specially configured conduits for carrying fluids into and out of tanks utilizing a single tank opening. More specifically, the novel features of the present invention are used in conjunction with a residential or other hot water tank and a supplementary water heating means, such as a solar water heating apparatus, a low compression heat pump and heat exchanger, or a hydronic boiler and heat exchanger, for example.

2. Description of the Prior Art

It is generally known to provide inflow and outflow means for handling fluids through a single tank opening. The patent to Hesse et al U.S. Pat. No. 4,124,137 discloses a vessel with several conduits passing through a single opening such that one conduit extends nearly to the bottom of the tank and the other conduit extends close to the top of the tank. This tank opening arrangement is at the top of the tank where no fluid would naturally flow out of the opening. Hesse et al disclose several tubes passing through a single tank opening.

The patent to Wittersheim et al U.S. Pat. No. 3,559,701 discloses a single opening combination fluid inlet and gas outlet valve for refilling aerosol spray containers. The problem of handling hot water in a heater, partially produced by an outside source, is not discussed.

An important application of the novel circuitry of the present invention is in the addition of supplemental heating means, such as a low compression heat pump, to existing residential or other water heating systems.

Existing heat pumps designed to supplement residential or other water heating systems require two openings in the hot water tank; one for cool water flowing out of the tank and into the heat pump and one for warm water flowing out of the heat pump and into the hot water tank. Generally, existing heat pumps have a cool water outflow line connected to the tank's drain opening. Since many of these heat pumps are sold as retrofit packages for existing hot water tanks, the requirement of two tank openings presents several problems. The first problem is the cost and bother of making an opening in the hot water tank.

In addition to the cost of cutting one additional opening in an existing hot water tank, many retrofitters attempt to cut costs and installation aggravation by making no additional openings in the hot water tank, using instead the tank's pressure-temperature relief valve opening as the second conduit opening for depositing water from the supplemental heat source. This creates an extremely dangerous situation. Explosive conditions in the hot water tank can be caused by tampering with the pressure-temperature relief valve when installing a sealed heat pump system line, thereby seriously endangering human life.

The novel circuitry of the present invention allows the addition of a supplemental heat pump for heating water without making an additional opening in the hot water tank and without disturbing the important safety function of the pressure-temperature relief valve.

An important characteristic of most hot water heaters is that a temperature gradient naturally exists vertically with the height of water in the tank. Thus, in the usual hot water heater tank there are water strata having different temperatures, with the warmest stratum being at an upper portion of the tank and the coolest stratum being at a lower portion of the tank. One of the major problems with the heat pumps of the prior art concerns their failure to take best advantage, or even to acknowledge the existence, of this temperature gradient. Specifically, prior art heat pump retrofits fail to deposit the warmed (e.g. 120° F.) incoming water from the heat pump to the optimum usable position in the hot water tank without "temperature-dilution" of the even hotter water at the top of the tank. This is especially so when the pressure-temperature relief valve opening, required in many states to be placed within six inches of the top of the hot water tank, is used to convey the warm incoming water.

The novel circuitry of the present invention is able to deposit the warmed incoming water from the heat pump directly to that water stratum having a temperature substantially equal to the temperature of the incoming water. Thus, the novel circuitry of the present invention does not disturb the temperature stratification existing in the hot water tank and more importantly does not mix the warm incoming water with the even hotter water already existing at the top of the tank.

OBJECTS OF THE INVENTION

An important object of the invention is to provide for the installation of a supplemental heating means for an existing hot water tank without requiring the cutting of any additional holes in the tank.

Another object of the invention is to provide inflow and outflow circuitry for existing hot water tanks in order to supplement hot water heating systems through the use of heat pumps, heat exchangers, solar heating apparatus or other low cost, energy efficient supplemental heating means.

It is a further object of the invention to provide a means for quickly and easily installing such supplemental heating sources to existing hot water tanks thereby promoting the use of more energy efficient water heating devices, such as solar water heaters and low compression heat pumps, for example.

SUMMARY OF THE INVENTION

A novel circuitry is provided to attain the foregoing and other objects, including a conduit having a plurality of openings, a centrally disposed conduit attached in fluid-sealing relation to one of said openings, and a space, around said centrally disposed conduit, in fluid-sealing relation to the other conduit openings. The novel circuitry is able to carry both streams flowing into and out of a tank through one tank opening. The present invention permits easy installation of a supplemental heating source by providing such circuitry connected to an opening in a hot water tank.

BRIEF DESCRIPTION OF THE DRAWINGS

This invention, its organization, construction, and operation, will be best understood from the following detailed description taken in conjunction with the accompanying drawings, in which.

Figure 1:
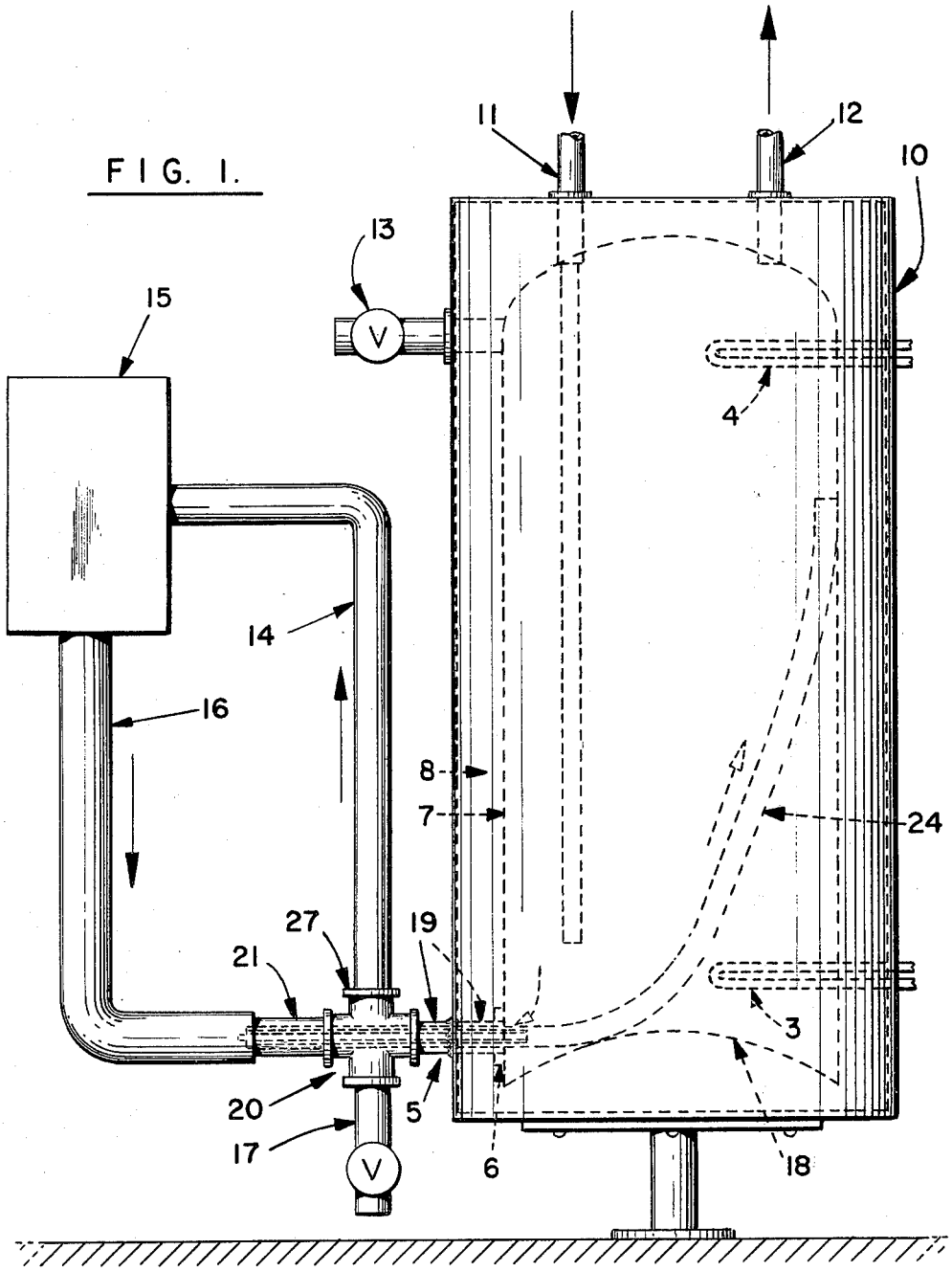
FIG. 1 is a side sectional view of an ordinary residential hot water tank and one embodiment of the novel circuitry of the present invention.

Although specific forms of the invention have been selected for illustration in the drawings, and although specific terms will be used in this specification in describing the features illustrated therein, these are not intended to define or to limit the scope of the invention, which is defined in the appended claims.

DESCRIPTION OF THE PREFERRED EMBODIMENTS

Referring to FIG. 1, a hot water tank 10 is shown with cold water inlet line 11, hot water outlet line 12, pressure-temperature relief valve 13, tank bottom 18 and electrical heating elements 3 and 4. In addition, a drain opening 5 is provided in the side wall near the bottom of the tank and an extension nipple 19 has been screwed into threaded drain bushing 6. As is clearly shown in FIG. 2, bushing 6 is welded to the inner tank wall 7 at drain opening 5. The composite side wall of tank 10 consists of outer jacket 9, insulating layer 8 and inner wall 7.

In tank 10, as in many hot water tanks, the drain opening 5 is located below the top of the crown of bottom 18. "Cross" pipe fitting 27 is connected to extension nipple 19. Thus, by inserting and feeding flexible plastic tube 24 through both "cross" pipe fitting 27 and extension nipple 19, the leading end of flexible plastic tube 24 hits and deflects off the crown of bottom 18 toward the top of the tank. Hence, further insertion of flexible plastic 24 causes its leading end to advance higher in tank 10. In the preferred embodiment shown in FIG. 1, flexible plastic tube 24 is long enough so that upon connection of the dual flow circuitry 20, the leading end of tube 24 rests at an upper predetermined level in tank 10.

"Cross" pipe fitting 27 is fastened to fluid-sealing relation to extension nipple 19. Also attached in fluid-sealing relation to "cross" pipe fitting 27 is cold water line 14, leading to supplemental heating means 15, and hot water line 16, leading from supplemental heating means 15. Also connected to "cross" pipe fitting 27 is drainage valve 17. Valve 17 can also be an ordinary plug as is shown in FIG. 2.

Figure 2:
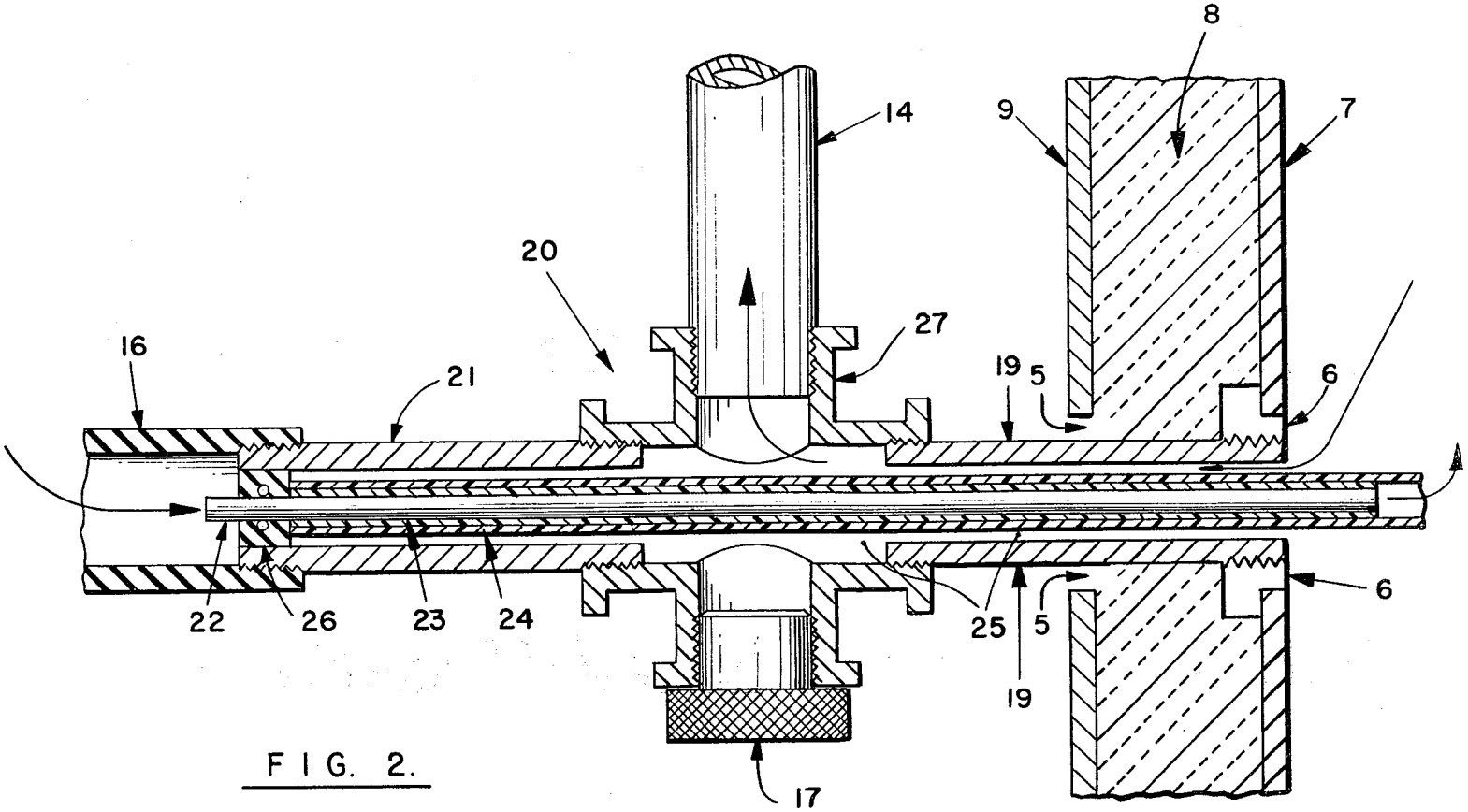
FIG. 2 is a side sectional view of the novel circuitry shown in FIG. 1.

Referring now to FIG. 2, the dual flow circuitry 20 is shown in relation to extension nipple 19, cold water line 14 and hot water line 16. In FIG. 2 the dual flow circuitry 20 is shown as a "cross" pipe fitting 27 having four openings, the first opening being attached to extension nipple 19 in fluid-sealing relation thereto. Opposite the first "cross" pipe fitting 27 opening, is a second opening connected in fluid-sealing relation to one end of conduit 21. The other end of conduit 21 is connected in fluid-sealing relation to hot water line 16. Within conduit 21 is a centrally disposed pipe 22 connected in fluid-sealing relation to the inside of conduit 21 by a tight fitting annular plug 26. Thus, hot water from line 16 enters the "hot" part of the dual flow circuitry 20 by flowing through pipe 22.

Surrounding pipe 22 and in fluid-sealing relation thereto is a plastic sleeve 23. Surrounding plastic sleeve 23 and in fluid-sealing relation thereto is flexible plastic tube 24 whose leading ends extends to a predetermined level in the tank 10. Surrounding flexible plastic tube 24 within extension nipple 19 and "cross" pipe fitting 27 is an annular space 25. Annular space 25 is open to the tank itself in the area of the tank opening 5. Thus, cooler water from a lower portion of the tank, in the area of tank opening 5, is drawn into annular space 25 and becomes the cold water feed through line 14 to supplemental heating means 15. After this water is warmed by the supplemental heating means 15, it flows through line 16 into pipe 22 and then flows through flexible plastic tube 24. Thus, the hot water from the supplemental heating means is deposited directly to a warmer stratum of the hot water tank, away from the cool water outlet, without mixing with the cooler water in a lower location in tank 10. By depositing the hot water in a location away from annular space 25 and tank opening 5, a greater temperature difference is maintained between the inflow to, and the outflow from, the supplemental heating means 15. This is important where supplemental heating means 15 is a heat pump since a greater temperature differential between the inflow and outflow streams enhances the efficiency of the heat pump cycle.

Although the hot water tank 10 shown in FIG. 1 has a specific form and configuration, it should be appreciated that tank 10 may have other configurations for purposes of the present invention. For example, pressure-temperature relief valve 13 could also be located in the very top of tank 10 and tank bottom 18 could be "dish" shaped rather than the crowned bottom shown.

Similarly, flexible plastic tube 24 need not be as long as that shown in FIG. 1 in order to obtain high efficiencies, through large temperature differences between the incoming and outgoing water, in a supplemental heat pump. As long as the leading end of flexible plastic tube 24 is positioned far enough away from drain opening 5 to prevent mixing with, and warming of, the cool outgoing water, the objects of the present invention will be achieved. Furthermore, the crowned bottom 18 is not an essential element of the present invention. Although crowned bottom 18 presents an effective way of positioning the leading end of flexible plastic tube 24 at an upper predetermined level in the tank 10, this positioning can be achieved through other means, such as preforming the leading end of flexible plastic tube 24 with a slightly upward bend. Then tube 24 is then fed through extension nipple 19, it takes advantage of its preformed curvature and thereby deflects off the opposite tank side wall in an upward direction. Furthermore as was stated above, a long flexible plastic tube 24 is not necessary and a short tube extending to the opposite tank wall will be sufficient to achieve an efficient heat pump cycle.

A further variation of the present invention concerns pipe 22. Pipe 22 is shown as a rigid structure surrounded by a plastic sleeve 23 and further surrounded by flexible plastic tube 24. This arrangement is desirable when pipe 22 is composed of a corrodible material, such as copper for example, since sleeve 23 will inhibit electrolytic corrosion of pipe 22. However, it is within the scope of the invention to provide one long tube extending from annular plug 26 to a predetermined level in the hot water tank 10.

Although this invention has been described in connection with specific forms thereof, and with respect to specific steps of the methods herein involved, it will be appreciated that a wide variety of equivalents may be substituted for those specific elements shown and described herein, that certain features may be used independently of other features, and that certain parts and method steps may be reversed, all without departing from the spirit and scope of this invention as defined in the appended claims.

I claim:

1. Dual flow circuitry, adapted to connect in fluid-communication with an opening in the side of a heated residential hot water tank, containing water having a plurality of temperature layers, said circuitry including a conduit able to carry both an inflowing and an outflowing stream, said conduit comprising:

a. a first cylindrical pipe connected in fluid-sealing relation to said tank opening at one end and connected in fluid-sealing relation to a "cross" pipe fitting at the other end;

b. said "cross" pipe fitting having four openings;

c. a second cylindrical pipe having an annual plug, in fluid-sealing relation to the interior of said second cylindrical pipe, and a centrally disposed tube, in fluid-sealing relation to said annular plug and extending through and annularly spaced from said second cylindrical pipe, said "cross" pipe fitting and said first cylindrical pipe;

d. a valve sealing off one "cross" pipe fitting opening;

e. supplemental residential water heating means having a cold water inflow and a hot water outflow streams, said inflow stream in fluid-communication with the fourth opening in said "cross" pipe fitting and said outflow stream in fluid-communication with said centrally disposed tube; and f. said centrally disposed tube being composed of a flexible material such that upon insertion through said opening in said hot water tank said tube extends to an upper predetermined level in said tank.

2. The dual flow circuitry as defined in claim 1, wherein a second centrally disposed tube, having one end fixedly attached to, and in fluid sealing relation with, said annular plug and having another end in freely slidable, fluid-sealing relation with said centrally disposed tube, is provided.

3. The dual flow circuitry as defined in claim 2, wherein said second centrally disposed tube is rigid.

4. The dual flow circuitry as defined in claim 3, wherein said second centrally disposed tube is composed of a corrodible material and has a close-fitting noncorrodible sleeve.

* * * * *